United States Patent [19]

Seki

[11] 4,413,947

[45] Nov. 8, 1983

[54] FAN ARRANGEMENT

[75] Inventor: Nakanobu Seki, Yokohama, Japan

[73] Assignee: Nissan Motor Company, Limited, Yokohama, Japan

[21] Appl. No.: 300,743

[22] Filed: Sep. 10, 1981

[30] Foreign Application Priority Data

Oct. 24, 1980 [JP] Japan ..... 55-151891

[51] Int. Cl.[3] ..... F00I 1/02; F01P 7/10

[52] U.S. Cl. ..... 415/182; 123/41.49

[58] Field of Search ..... 415/182, 213 C; 123/41.49, 41.48

[56] References Cited

U.S. PATENT DOCUMENTS

| | | | |
|---|---|---|---|
| 1,068,097 | 7/1913 | Benjamin | 123/41.49 |
| 2,130,910 | 2/1935 | Smith | 415/182 X |
| 3,169,694 | 4/1963 | Borchers | 415/213 C |
| 3,727,593 | 4/1973 | Enke | 123/41.49 X |
| 3,937,189 | 2/1976 | Beck | 123/41.49 |
| 4,062,401 | 12/1977 | Rudny et al. | 123/41.49 X |
| 4,189,281 | 2/1980 | Katagiri et al. | 415/213 C |

FOREIGN PATENT DOCUMENTS

| | | | |
|---|---|---|---|
| 376647 | 7/1932 | United Kingdom | 415/182 |
| 1576818 | 10/1980 | United Kingdom | 415/213 C |

*Primary Examiner*—Harvey C. Hornsby
*Assistant Examiner*—Shewen Bian
*Attorney, Agent, or Firm*—Lane, Aitken & Kananen

[57] ABSTRACT

A fan arrangement has a rotatable fan, a plurality of blades formed on the fan, and a shroud. The blades extend radially and are spaced circumferentially. The blades also extend perpendicularly to the radial direction. The base angle of each blade is set at a value of 55° to 75°. The shroud is located on the periphery of the fan so as to cover a part of the fan in such a manner that the fan is partially exposed at its downstream part and a clearance is formed therebetween. The covering percentage of the shroud relative to the fan is set at a value of 50% to 90%. The covering percentage is defined as $100 \cdot L_2/L_1$, where $L_1$ is the axial width of the outer edge of each blade and $L_2$ is the axial distance of the shroud from the downstream end thereof to a point in the same axial position as the upstream end of the outer edge of each blade.

7 Claims, 4 Drawing Figures

FAN ARRANGEMENT

BACKGROUND OF THE INVENTION

1. Field of the Invention

This invention relates to a fan arrangement wherein a fan is partially covered by a shroud to increase the air supply or draw efficiency.

2. Description of the Prior Art

In a conventional fan arrangement for cooling an automotive radiator and thus an automotive engine, the fan behind the radiator is surrounded by a shroud to increase draft of air through the radiator to improve engine cooling. The shroud assures that all air pulled back by the fan must first pass through the radiator, so that it increases the efficiency of the fan. There are some parameters affecting air supply or draw efficiency of such a fan arrangement. The parameters are, for example, the clearance between the fan and the shroud, the inclination of the fan blades, and the covering percentage of the shroud relative to the fan.

SUMMARY OF THE INVENTION

It is an object of the present invention to provide a fan arrangement with a shroud surrounding the fan, which produces an optimum air supply or draw efficiency.

The fan arrangement of the present invention has a rotatable fan, a plurality of blades formed on the fan, and a shroud. The blades extend radially and are spaced circumferentially. The blades also extend perpendicularly to the radial direction. The base angle $\theta$ of each blade is set at a value of 55° to 75°. The base angle is defined by the angle at which lines A and B intersect, where the line A corresponds to the longest chord of the transverse section of each blade at its base and the line B is the line of intersection between the section plane for the blade and the perpendicular plane with respect to the fan axis of rotation. The shroud is located on the periphery of the fan so as to cover a part of the fan in such a manner that the fan is partially exposed at its downstream part and a clearance is formed between the shroud and the fan. The covering percentage of the shroud relative to the fan is set at a value of 50% to 90%. The covering percentage is defined as $100 \cdot L_2/L_1$, where $L_1$ is the axial width of the outer edge of each blade and $L_2$ is the axial distance of the shroud from the downstream end thereof to a point in the same axial position as the upstream end of the outer edge of each blade.

The above and other objects, features and advantages of the present invention will be apparent from the following description of preferred embodiments thereof, taken in conjunction with the drawings.

DESCRIPTION OF THE PREFERRED EMBODIMENTS

Figure 1:
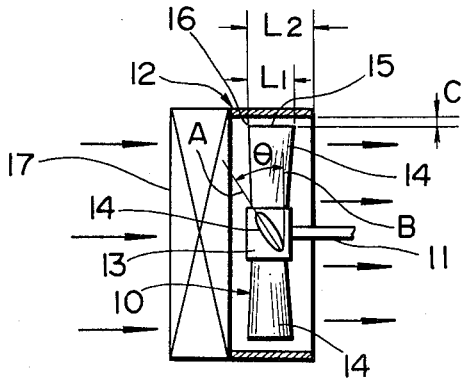
FIG. 1 is a diagrammatic sectional view of a basic fan arrangement for experiments on determining optimum parameters.

With reference to FIG. 1, there is shown a basic fan arrangement for experiments on determining optimum parameters thereof. The fan arrangement has a fan 10 mounted on a shaft 11, and a shroud 12 surrounding or covering the fan 10.

The fan 10 consists of a columnar hub 13 concentrically fixed to the shaft 11, and a plurality of circumferentially-spaced, radially extending identical blades 14 attached to the hub 13. The blades 14 slightly extend perpendicularly to the radial direction, obliquely to the axial and circumferential directions, with respect to the hub 13. The shaft 11 is coupled to driving means (not shown) to be rotated. The shroud 12 is in the form of a cylinder having such an inside diameter as to coaxially surround the fan 10 with a clearance C between the outer edges 15 of the blades 14 and the inner surface 16 of the shroud 12. A body 17, such as a radiator, to be cooled is adjacent to and just in front of the inlet opening of the shroud 12. When rotated together with the shaft 11 in the normal direction, the fan 10 draws air through the body 17 and the inlet or upstream opening of the shroud 12 to cool the body 17 and discharges it through the outlet or downstream opening of the shroud 12.

The lengthwise direction of the transverse section of each blade 14 inclines from both the fan axis of rotation and the perpendicular with respect to the fan axis of rotation. The angle $\theta$ at which the lines A and B intersect as illustrated is hereinafter referred to as a base angle $\theta$ of the blade 14, where the line A corresponds to the longest chord of the transverse section of each blade 14 at its base and the line B is the line of intersection between the section plane for the blade and the perpendicular plane with respect to the fan axis of rotation. Each blade 14 has an axial width. As illustrated, $L_1$ denotes the axial width of the outer edge of each blade 14, while $L_2$ denote the axial distance of the shroud 12 from the downstream end thereof to a point in the same axial position as the front end of the outer edge of each blade 14. The value $100 \cdot L_2/L_1$ thus defines a covering percentage of the shroud 12 relative to each blade 14 or the fan 10 when the shroud 12 surrounds a part of each blade 14.

Figure 2:
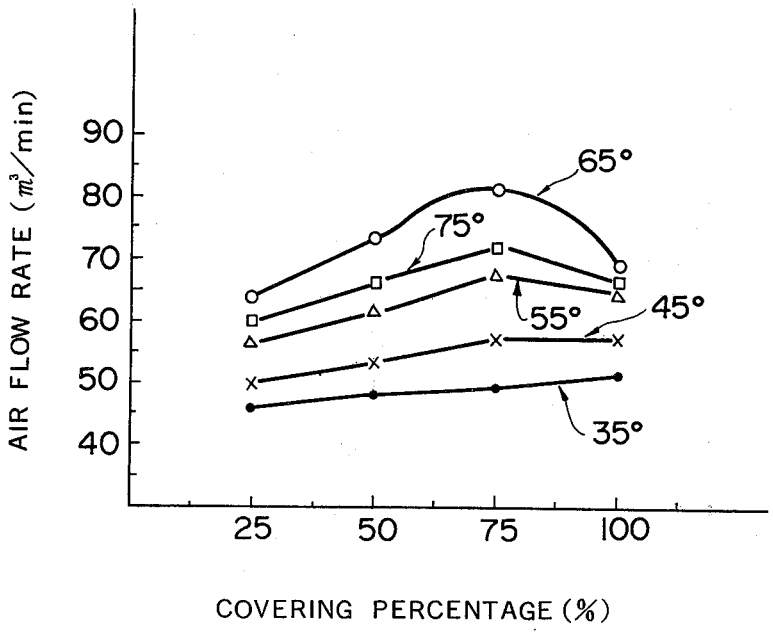
FIG. 2 is a graph of the results of experiments, where the ordinate corresponds to the air flow rate through the fan arrangement of FIG. 1 and the abscissa corresponds to a covering percentage of the shroud relative to the fan of the fan arrangement.

The experiments on determining the optimum parameters of the fan arrangement have been performed by measuring the rate of air flow through the fan arrangement while changing the covering percentage of the shroud 12 relative to the fan 10 at each of several values of the base angle $\theta$ of the blade 14. The clearance C between the fan 10 and the shroud 12 is maintained at 20 mm, and the rotational speed of the fan 10 is also maintained at 3,000 rpm, during the experiments. The results of the experiments are shown in FIG. 2, where the ordinate corresponds to the air flow rate ($m^3$/min.) and the abscissa corresponds to the covering percentage (%). The five curves have been obtained with the base angle $\theta$ of the blade 14 set at 35°, 45°, 55°, 65°, and 75° respectively.

According to the results of the experiments shown in FIG. 2, when the base angle $\theta$ of the blade 14 is relatively small, around 40°, the covering percentage of the shroud 12 relative to the fan 10 does not greatly affect the air flow rate through the fan arrangement although the air flow rate slightly increases with the covering percentage. In fact, when the base angle $\theta$ of the blade 14 is relatively small, the clearance C between the fan 10 and the shroud 12 affects the air flow rate through the fan arrangement more than the covering percentage does. On the other hand, when the base angle $\theta$ of the blade 14 is relatively large, above about 50°, the air flow rate decreases with the covering percentage provided that the covering percentage is above 75%.

In conclusion, when the covering percentage of the shroud 12 relative to the fan 10 is 50% to 90% and the base angle $\theta$ of the blade 14 is 55° to 75°, the optimum efficiency of the fan arrangement is obtained in point of the air flow rate through the fan arrangement. When the covering percentage is around 75% and the base angle $\theta$ is around 65°, the optimal efficiency of the fan arrangement is obtained.

Figure 3:
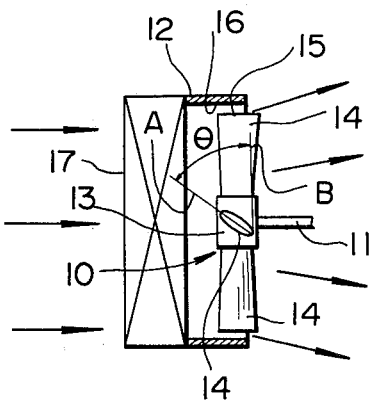
FIG. 3 is a diagrammatic sectional view of a fan arrangement according to an embodiment of the present invention.

A fan arrangement according to an embodiment of the present invention is shown in FIG. 3, wherein the corresponding or like elements are designated by the same numerals or letters as those of FIG. 1. This fan arrangement is tailored in a similar manner to that of FIG. 1 except for the following design. Each blade 14 is attached to a hub 13 at an angle of 60° to 70° with the perpendicular to the fan axis of rotation. In other words, the base angle $\theta$ of the blade 14 is set at from 60° to 70°. The base angle $\theta$ of the blade 14 may be preferably set at from 55° to 75°, and most preferably at around 65° with the foregoing results of the experiments taken into account. Each blade 14 is somewhat twisted about its length in the radial direction so that the angles similar to the base angle $\theta$ of the blade 14 decrease gradually from its base to its outer edge. This twisted configuration of the blades 14 prevents a decrease in the air flow rate through the arrangement due to the air stream separation in a conventional way. In this embodiment, the angle of the blade 14 at its outer edge, similar to the base angle $\theta$, is set at from 50° to 60°.

The shroud 12 is so located on the periphery of the fan 10 that the shroud 12 will cover all of the fan 10 from the upstream end except for the far-downstream part of the fan 10. Thus the fan 10 is partially exposed only at its downstream part. In practice, the hereinbefore defined covering percentage of the shroud 12 relative to each blade 14 or the fan 10 is set at a value of 50% to 90%. The covering percentage may be set most preferably at around 75% with the foregoing results of experiments taken into account. The clearance C between the fan 10 and the shroud 12 is set at 20 mm.

This fan arrangement causes the discharge air flow to spread conically because the relatively large value of the base angle $\theta$ of the blade 14 causes centrifugal air streams in addition to the main axial air stream. The setting from 50% to 90% for the covering percentage of the shroud 12 relative to the fan 10 allows the conically-spreading discharge air flow to travel freely, because the downstream part of the fan 10 is not covered by the shroud 12. As a result, this configuration prevents the shroud 12 from offering resistance to the discharge air flow from the fan arrangement.

Figure 4:
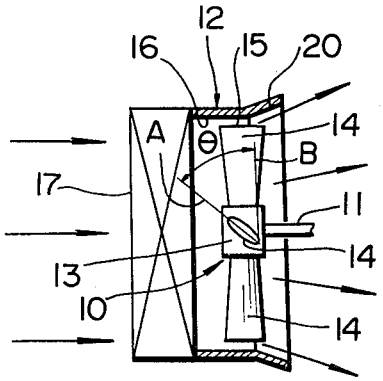
FIG. 4 is a diagrammatic sectional view of a fan arrangement according to another embodiment of the present invention.

A fan arrangement according to another embodiment of the present invention is shown in FIG. 4, wherein the corresponding and like elements are designated by the same numerals and letters as those of FIG. 3. This fan arrangement is tailored in a similar manner to that of FIG. 3 except for the following design change. A shroud 12 is provided at its downstream end with a partial-cone shaped, hollow member 20, which is coaxial with the fan 10 and the shroud 12. The conical member 20 has smaller and greater openings at its opposite ends. The smaller end of the conical member 20 has the same inside diameter as that of the downstream end of the shroud 12 so as to be attached to the same with a continuous passage formed inside them. Thus the smaller end of the conical member 20 is upstream of the larger end thereof with respect to the air flow. The apical angle of the conical member 20 is set equal to or greater than the apical angle of the cone formed by the discharge air flow. The conical member 20, therefore, protects the conically-spreading discharge air flow and assures the occurrence of the shapely conical discharge air flow, thereby further increasing the air flow rate through the fan arrangement and thus the efficiency thereof.

Moreover the conical member 20 reduces fan noise compared to the fan arrangement of FIG. 3. The conical member 20 also prevents counter or circulating air streams, near outer edge of the fan 10, causing a decrease in the efficiency of the fan arrangement. Meanwhile the greater the clearance C between the fan 10 and the shroud 12, the more the counter or circulating air streams near outer edge of the fan 10. By maintaining the counter or circulating air streams at the same level, the provision of the conical member 20 thus allows the clearance C between the fan 10 and the shroud 12 to be set greater. This design of greater clearance C provides relatively easy manufacture of the fan arrangement because the location of the shroud 12 relative to the fan 12 requires less accuracy.

It should be understood that further modifications and variations may be made in the present invention without departing from the spirit and scope of the present invention as set forth in the appended claims.

What is claimed is:

1. A fan arrangement comprising:

(a) a rotatable fan (10);

(b) a plurality of blades (14) formed on the fan, the blades extending radially and being spaced circumferentially, the blades also extending perpendicularly to the radial direction, a base angle $\theta$ of each blade being set at a value of 55° to 75°, the base angle $\theta$ being defined by the angle at which lines A and B intersect where the line A corresponds to the longest chord of the transverse section of each blade at its base and the line B is the line of intersection between the section plane for the blade and perpendicular plane with respect to the fan axis of rotation; and (c) a shroud (12) located on the periphery of the fan so as to cover a part of the fan in such a manner that the fan is partially exposed at its downstream part and a clearance is formed between the shroud and the fan, the covering percentage of the shroud relative to the fan being set at a value of 50% to 90%, the covering percentage being defined as $100 \cdot L_2/L_1$, where $L_1$ is the axial width of the outer edge of each blade and $L_2$ is the axial distance of the shroud from the downstream end thereof to a point in the same axial position as the upstream end of the outer edge of each blade, the optimum covering percentage depending on the base angle $\theta$.

2. A fan arrangement as recited in claim 1, wherein the shroud is provided at its downstream end with a partial-cone shaped, hollow member (20) having smaller and greater openings at its opposite ends, the smaller end of the cone shaped member being attached to the downstream end of the shroud in such a manner that the cone shaped member will be coaxial with the fan.

3. A fan arrangement as recited in claim 1 or 2, wherein the covering percentage of the shroud relative to the fan is set at around 75%.

4. A fan arrangement as recited in claim 1 or 2, wherein the base angle $\theta$ of each blade is set at around 65°.

5. A fan arrangement as recited in claim 1 or 2, wherein the clearance between the fan and shroud is set at 20 mm.

6. A fan arrangement as recited in claim 1 or 2, wherein the covering percentages of the shroud relative to the fan is set at around 75%; the base angle $\theta$ of each blade is set at around 65°; and the clearance between the fan and shroud is set at 20 mm.

7. A fan arrangement as recited in claim 1 or 2, wherein each blade is twisted so that the angles similar to the base angle $\theta$ of the blade will gradually decrease from its base to its outer edge.

* * * * *